United States Patent [19]

Martens et al.

[11] 3,974,581

[45] Aug. 17, 1976

[54] ANTI-THEFT FASTENING DEVICE AND TOOL FOR RELEASING SAME

[75] Inventors: Henry J. Martens, Lynnfield; Jan Vandebult, Topsfield, both of Mass.

[73] Assignee: I. D. Engineering, Inc., Peabody, Mass.

[22] Filed: Apr. 14, 1975

[21] Appl. No.: 568,152

Related U.S. Application Data

[62] Division of Ser. No. 519,270, Oct. 30, 1974, Pat. No. 3,911,534.

[52] U.S. Cl. ..... 40/20 R; 24/155 BR; 317/123; 340/280

[51] Int. Cl.[2] ..... A44B 9/00; G08B 21/00; H01H 47/00

[58] Field of Search ..... 24/150 R, 155 BR, 49 P, 24/49 CP; 40/2 R, 20 R; 279/1 M, 22; 85/5 B; 340/258 D, 280; 317/123

[56] References Cited

UNITED STATES PATENTS

| | | | |
|---|---|---|---|
| 486,208 | 11/1892 | Dancyger | 40/20 R UX |
| 1,089,755 | 3/1914 | Fischer | 24/155 BR |
| 1,409,815 | 3/1922 | Belknap | 24/155 BR |
| 1,465,212 | 8/1923 | Evans | 40/2 R |
| 1,577,678 | 3/1926 | Behrman | 279/22 UX |
| 1,635,144 | 7/1927 | Stevens | 335/289 X |
| 3,678,608 | 7/1972 | Minasy | 40/20 R |

*Primary Examiner*—Donald A. Griffin
*Attorney, Agent, or Firm*—Beall & Jeffery

[57] ABSTRACT

A fastening device for securing articles together, the device including releasably connected male and female components. The male component comprises a pin and the female component comprises a retaining insert positioned in a housing for releasably clamping the pin. When joined, the pin can not be separated from the retainer except by a special tool. The insert is of magnetic material, and an actuating tool including an electromagnet is employed to actuate the insert to permit removal of the pin. The housed insert is attached to a tag, with the tag being attached to the article which is to be sold. The tag houses an electrical circuit which activates an alarm if the tag is not properly removed at the checkout point by means of the special tool.

5 Claims, 8 Drawing Figures

FIG. 1
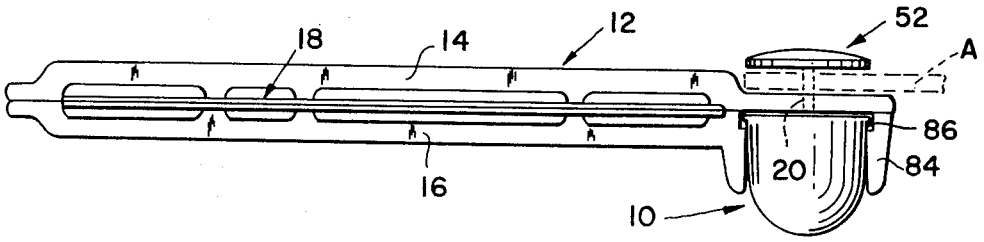
FIG. 2
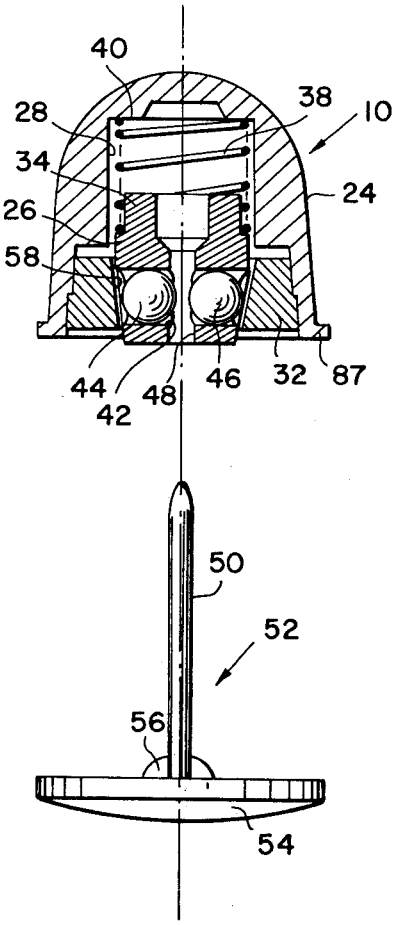
FIG. 7
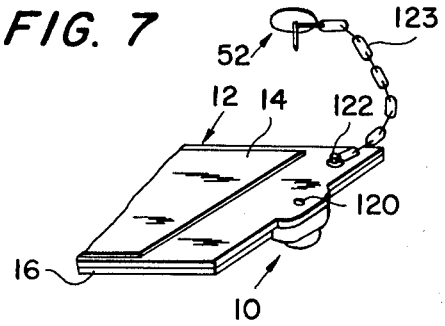
FIG. 8
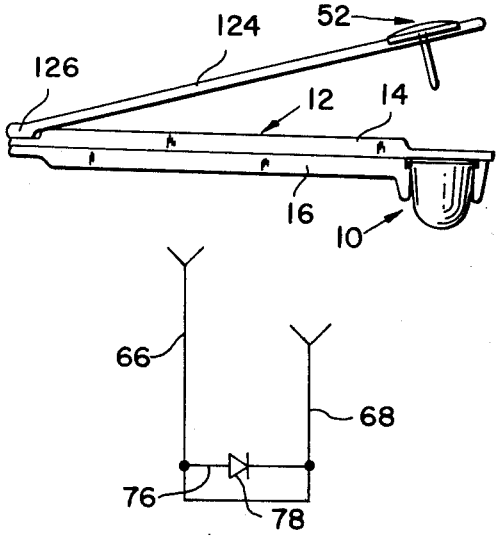
FIG. 4

ANTI-THEFT FASTENING DEVICE AND TOOL FOR RELEASING SAME

This is a division of application Ser. No. 519,270, filed Oct. 30, 1974 and now U.S. Pat. No. 3,911,534, issued Oct. 14, 1975.

BACKGROUND OF THE INVENTION

The present invention relates as indicated to a fastening device and a tool for releasing the same, and relates more particularly to a fastening device which can be attached to an article or articles in such a manner that the device can be separated only by the use of a special tool located for example, at a checkpoint in a department store or the like. In accordance with the present invention, the fastening device is secured to an identification tag with the assembly in turn being temporarily secured to articles prior to the authorized handling and sale of such articles, at which time the identification tag and device can be removed from the article. The invention is thus highly useful for purposes of anti-theft detection in department stores and the like where the identification tag must be removed from the article purchased during the check-out process. If a person attempts to surreptitiously remove the article from the store without purchasing the same, the identification tag remains attached to the article contains electric circuity which triggers an alarm system at an exit point or points in the store.

The fastening device constructed in accordance with the present invention comprises an improvement over the fastening devise disclosed and claimed in pending Applicaton Ser. No. 307,366, filed Nov. 17, 1972 in the name of Martin A. J. Martens and entitled "Fastening Clip." In accordance with such earlier application, the fastening device likewise comprised a male component in the form of a pin and a female component in the form of a retainer resiliently mounted in a housing. The coupling of the pin to the retainer, with the pin extending through the article to be sold, precluded disengagement of the pin from the retainer except by a special tool. The construction of the retainer and housing was such as to permit activation of the retainer and consequent release of the pin either mechanically or magnetically. When mechanically activated, a detaching tool is inserted through a top opening in the housing in which the retainer is mounted for withdrawing the retainer to permit release of the pin. When magnetically activated, an electromagnet is positioned adjacent the same open end of the housing and the retainer, formed of magnetic material, is drawn toward the electromagnet thereby freeing the pin for removal from the retainer.

Although the fastening clip and described forms of activation in the noted application proved generally satisfactory, certain disadvantages did exist. In the form requiring mechanical activation, the use of the special tool is relatively time-consuming and required significant manual dexterity. In addition, the open end of the housing, required for mechanical activation, did not absolutely preclude tampering with the device in an effort to surreptitiously remove the device prior to checkout of the article.

SUMMARY OF THE INVENTION

A primary object of the present invention is to provide a fastening device which can be quickly and easily secured to the article or articles to be temporarily fastened, while at the same time providing a locking arrangement which positively prevents separation of the fastener components without a special tool. In accordance with the invention, any attempted removal or separation of the fastener components serves to increase the resistance to such separation. The female section of the fastener is constructed so as to prevent separation of the fastener components except by a specially designed tool.

A further, more specific object of the invention is to provide a fastening device in the form of a lock which is positioned in one half of a tag assembly, with the securing of the other half of the tag assembly preventing removal of the fastening device from the tag. The device is mounted in the tag in such a manner as to permit rotation thereof thereby preventing the pin from being unscrewed from the lock prior to authorized detaching of the pin from the lock. The lock housing is closed in the exteriorly exposed regions thereof to prevent access to the interior thereof.

Another object of the invention is to provide a lock and tag assembly which are of extremely rugged construction, thereby permitting repeated reuse of the lock and tag.

A still further object of the invention is the provision of a novel electromagnetic detaching tool for conditioning the lock for removal of the pin at the checkout station. In accordance with the invention the pin-retaining insert of the lock is formed of magnetic material whereby positioning of the detaching tool adjacent the exposed, closed end of the lock and actuation of the tool releases the pin from the insert positioned interiorly of the lock for removal of the pin. In accordance with the invention, the insert is spring biased away from the closed end of the lock into frictional engagement with a ring having a tapered inner surface complemental to the tapered outer surface of the insert. When the insert is so biased, retaining balls loosely positioned in the insert tightly frictionally engage the surface of the pin, with the frictional contact increasing when the pin is attempted to be removed from the lock prior to authorized removal of the pin at the checkout station by the detaching tool.

Yet another object of the invention is to provide such a detaching tool the electrical circuit of which includes an overload protection device which prevents overheating of the magnetic coil when the actuating switch for the tool is inadvertently left closed for longer than a predetermined time.

These and other objects of the invention will become apparent when the following description proceeds in particular reference to the application drawings.

BRIEF DESCRIPTION OF THE APPLICATION DRAWINGS

FIG. 1 comprises a side elevational view of the lock and tag assembly in accordance with the invention;

FIG. 2 is an exploded, partially sectioned view of the lock assembly and pin;

FIG. 4 is a circuit diagram of the tag assembly;

FIG. 7 is a modification showing the pin attached to the tag, and

FIG. 8 is a further modification showing the pin attached to a separate strip hinged to the tag.

DESCRIPTION OF THE PREFERRED EMBODIMENTS

Figure 3:
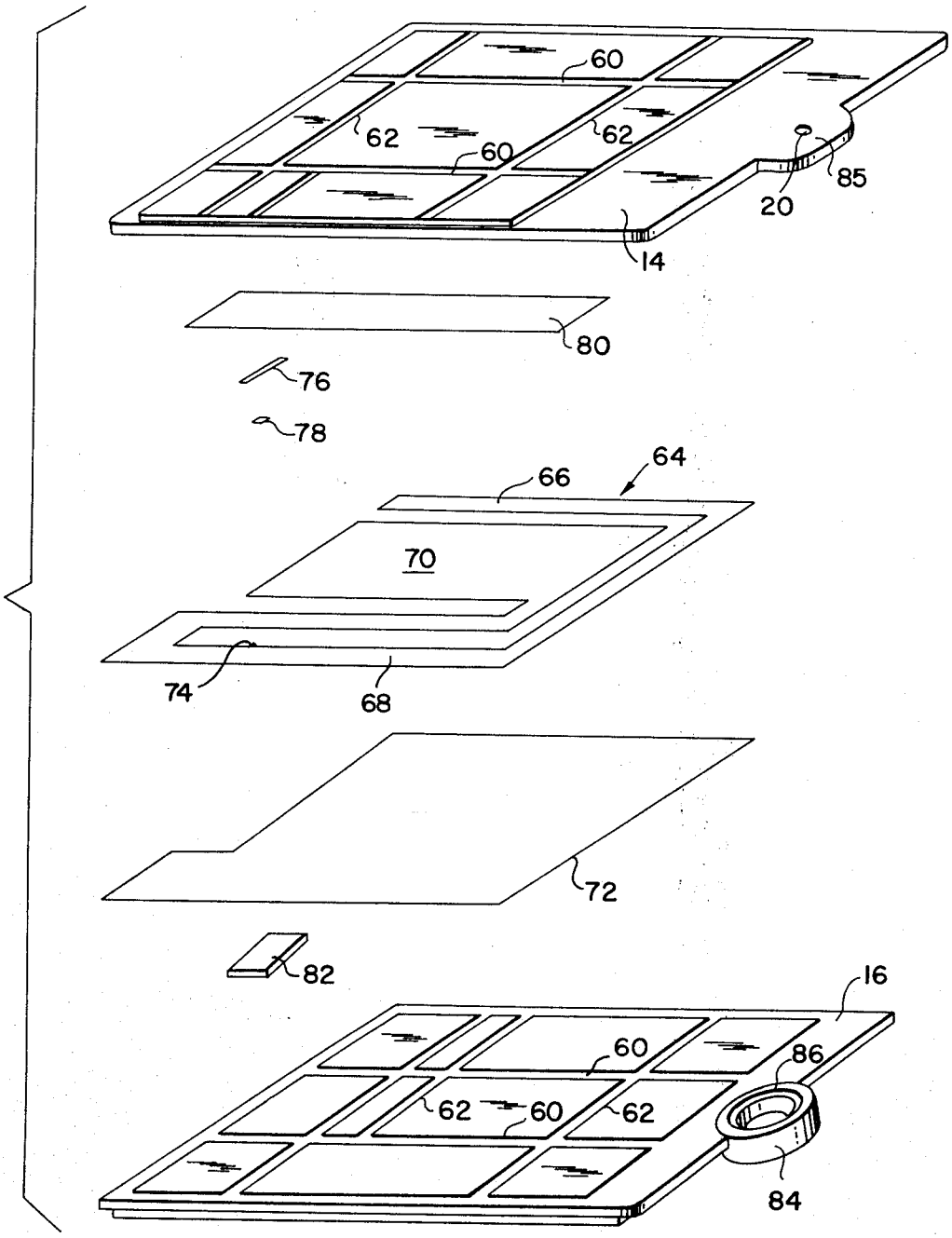
FIG. 3 is an exploded view of the tag assembly.

Referring now in more detail to the application drawings, wherein like parts are indicated by like reference numerals and initially to FIGS. 1 and 2, FIG. 1 illustrates an assembled lock and tag assembly, with the lock assembly being generally indicated at 10 and the tag assembly generally indicated at 12. The tag assembly comprises tag cover sections 14 and 16 which are formed with mating peripheral and interior portions so as to permit the sections to be rigidly secured together, with the construction of the tag sections to be hereinafter described when particular reference is made to FIG. 3. An antenna generally indicated at 18 is mounted between the tag sections for triggering an alarm circuit if the tag and lock assembly are surreptitiously removed from the premises without authorized removal of the tag from the article to be purchased at the checkout station, as will be hereinafter described in more detail. The tag section 14 is formed with an opening 20 generally aligned with the axis of the lock 10 through which the fastening pin can extend into frictional engagement with the lock, with the pin being shown in FIG. 1, attaching an article A, shown in dashed line, to the device.

Referring to FIG. 2, the lock assembly 10 comprises a housing 24 which is generally hat-shaped and closed at one end. An insert 26 is mounted for longitudinal movement in central bore 28 of the housing, and the housing is counter bored as shown at 30 to receive a retaining ring 32. The ring 32 and the bore 30 are dimensioned so as to permit press fitting of the ring into the bore for permanent retention in the housing, The housing is preferably made of "Lexan", a commercially available product sold by General Electric, although it will be understood that other suitable plastic materials could likewise be employed. The ring 32 is perferably formed of steel, as is the insert 26.

The insert 26 includes a relatively reduced diameter upper section 34 the bottom of which is defined by a shoulder 36 against which the bottom of a compression spring 38 engages, with the top of the spring engaging a flat annular surface 40 formed adjacent the closed end of the housing. The lower portion of the insert is tapered and formed with a transverse opening 42 within which retaining balls 44 and 46 are loosely mounted. A central bore 48 is formed in the insert of sufficient diameter to receive the shank portion 50 of a pin generally indicated at 52. The pin 52 further includes a head portion 54, with the shaft being secured to the head by soldering as shown in 56, or equivalent securing methods, in addition to the regular staking method. Such method of securing the shank to the head greatly strengthens the pin and permits repeated use of the same without fear of weakening or breaking.

The ring 32 is formed with a conically tapered inner surface 58 which complements the tapered lower portion of the insert 26, with the spring 38 biasing the insert downwardly so that the adjacent tapered surfaces of the insert and ring are in tight frictional contact. In such position, the retaining balls 44 and 46 are forced by the surface of the ring 58 into the axial bore 48 of the insert.

When the pin 52 is to be inserted into the lock assembly 10 the shank 50 of the pin is positioned in the axial bore 48 of the insert and the pin forced toward the closed end of the housing 24. In the position of the retaining balls 44, 46 shown in FIG. 2, the shaft 50 is precluded from moving past the balls, although continued movement of the shaft of the pin toward the closed end of the housing forces the insert 26 upwardly against the bias of spring 38. As the insert is raised in the housing, the retaining balls are able to move laterally outwardly in the transverse bore 42 thereby permitting the shaft 50 to travel past the adjacent surfaces of the retaining balls into the interior of the insert. When the head 54 of the pin is adjacent the article to which the tag and lock assembly is secured, the pin is released and the spring 38 biases the insert downwardly thereby biasing the retaining balls 44 and 46 into tight frictional engagement with the surface of the shank portion 50 of the pin. In this manner, the pin is rigidly secured in the lock, and any attempted removal of the pin prior to authorized removal at the checkout station serves only to increase the frictional resistance between the retaining balls 44 and 46 and the pin inasmuch as the attempted withdrawal of the pin serves to force the insert 26 downwardly against the tapered surface of the ring 32, against the inner surface of which the retaining balls 44 and 46 engage. There is thus provided a lock and pin assembly which is completely effective unless and until the lock assembly is actuated as will be hereinafter described to longitudinally upwardly move the insert 26 thereby freeing the pressure of the retaining balls 44 and 46 on the shank 50 of the pin. As above noted, the insert 26 is of steel, and positioning of the detaching tool adjacent the closed end of the housing and actuation thereof serves to withdraw the insert toward the closed end of the housing thereby conditioning the lock assembly for removal of the pin.

Referring now to FIG. 3, there is illustrated therein in exploded view the components of the tag assembly 12. It will be noted that the cover section 14 of the tag assembly is shown inverted in FIG. 3 and that when assembled the tag section will be positioned on the tag section 16 so that the internal rib constructions are adjacently disposed. As shown in FIG. 1, the exposed surfaces of the tag sections 14 and 16 when the tag is assembled are smooth to facilitate handling of the tag and to accommodate instructional or advertising printing on the tag surfaces.

Each tag section is formed with a series of longitudinal ribs commonly designated at 60 and transverse ribs commonly designated at 62 which extend perpendicular thereto, with the ribs in each section forming a grid-like internal construction. The longitudinal and transverse ribs in each section are located so as to be aligned when the tag section 14 is superimposed on the bottom tag section 16 prior to securing the sections together when the tag is assembled. The ribs 60 and 62 are primarily for the purpose of substantially strengthening the tag thereby to achieve the desired objective of repeated use of the tag. The tag construction together with the material employed for the tag, preferably ABS, although other rugged plastic material of equivalent properties could also be employed, provide a tag assembly which is virtually indestructible and capable of repeated use without significant deteriation. The surfaces of the ribs 60 and 62 are slightly recessed relative to the peripheral surfaces of the cover sections, as shown in FIG. 1, thereby to accommodate therebetween an antenna generally indicated at 64. The antenna 64 is generally U-shaped, including leg sections 66 and 68 and a center section 70. The antenna is preferably formed of brass, and is approximately 0.002 inches in thickness. The antenna is adhesively secured to an underlying tape member 72, a commercially purchased item from the Minnesota Mining and Manufacturing Company and sold under the product designation "3M270".

A projection 74 is provided on the antenna leg 68 for spacing longitudinally on such leg a gold plated brass ribbon 76 on which is secured a diode 78. Due to the relatively small size of the diode, the ribbon 76 is required to span the gap between the respective sections of the antenna leg 68 to establish electrical contact between the diode and the antenna. A second tape strip 80 extends over the antenna leg 68 overlying the ribbon and diode to further protect the same and to prevent premature failure of these members in the antenna circuit. To protect the diode on the bottom side thereof, a rubber insert 82 is positioned below the diode and supporting ribbon between the same and the tag cover section 16.

The assembly of the tag 12 should be apparent from the above description. After positioning the antenna and diode on the tag section 16 by the tape members as above described, the tag sections 14 and 16 are aligned as shown in FIG. 1, and ultrasonically welded whereby the tag sections are rigidly secured together. The positioning of the diode relative to the antenna leg 68, at the location of the projection 64, is relatively important so as to correctly tune the antenna to a certain frequency. The transmittal signal from the antenna section 68 is preferably double the signal received by the antenna section 66, and the diode must be fairly precisely positioned along the antenna leg 68 to obtain this doubling frequency characteristic.

As shown in FIGS. 1 and 3, the cover section 16 of the tag is formed with a tubular extension 84 at one end thereof for receiving the lock assembly 10, and the cover section 14 is formed with a semicircular projection 85 at its forward end which overlays and closes the tubular extension when the tag sections are superimposed and secured. The projection 85 is formed with opening 20 for receiving the shank 50 of pin 52.

The tubular extension 84 is recessed at 86 (FIG. 1) to receive the peripheral bottom flange (FIG. 2) formed on the lock housing 24. As seen in FIG. 2, the housing 24 is downwardly and outwardly tapered toward flange 87, which construction permits the lock housing to be rotated in the tubular extension 84 but prevents the lock from being withdrawn from the tag section 16 due to the flange 87. The lock 10 is dropped in the tubular extension 84 before the tag section 14 is secured to the lower tag section 16.

The ability of the lock 10 to rotate in the tag assembly as described, and the rounded, closed end of the lock, are of significant importance inasmuch as relative rotation of the pin and lock is inhibited when assembled thereby making difficult the removal of the pin from the lock prior to authorized removal at the checkout station. The head 54 of the pin is preferably positioned closely adjacent the tag cover 16 and of course the pin penetrates through the article to which the tag assembly is temporarily secured.

The circuit diagram for the tag assembly 12 is shown in FIG. 4, with the antenna legs 66 and 68 being schematically represented, and diode 78 and ribbon 76 extending between the antenna legs. As above noted, the receiving frequency at antenna leg 66, due to diode 78, is preferably doubled so that the transmitting frequency can be precisely detected at a chosen site or sites in the store at which detection equipment is positioned. In this regard, reference is made to my earlier U.S. Pat. No. 3,711,848 which specifically describes such detecting equipment, which is normally positioned at one or more exits from the store for the purpose of detecting articles attempted to be removed from the store with the tag still on the article. As described in my earlier patent, a transmitter unit is preferably positioned at one side of the exit and constantly transmits a signal at a predetermined frequency. When an article bearing a tag is attempted to be passed through the exit without authorization, the signal is picked up and doubled as described, with the higher signal being picked up by a receiver unit likewise positioned adjacent the exit for actuating an alarm circuit, with the alarm comprising a flashing light, bell or other audible or visual alarm, or combinations of these. Although the operating frequencies are not critical, preferably high frequency ranges are employed in order to preclude false actuation of the system by unprotected articles passing through the checkpoints, with the typical operating frequency at the lower range being 912 megacycles and the doubled frequency being 1824 megacycles.

Figure 5:
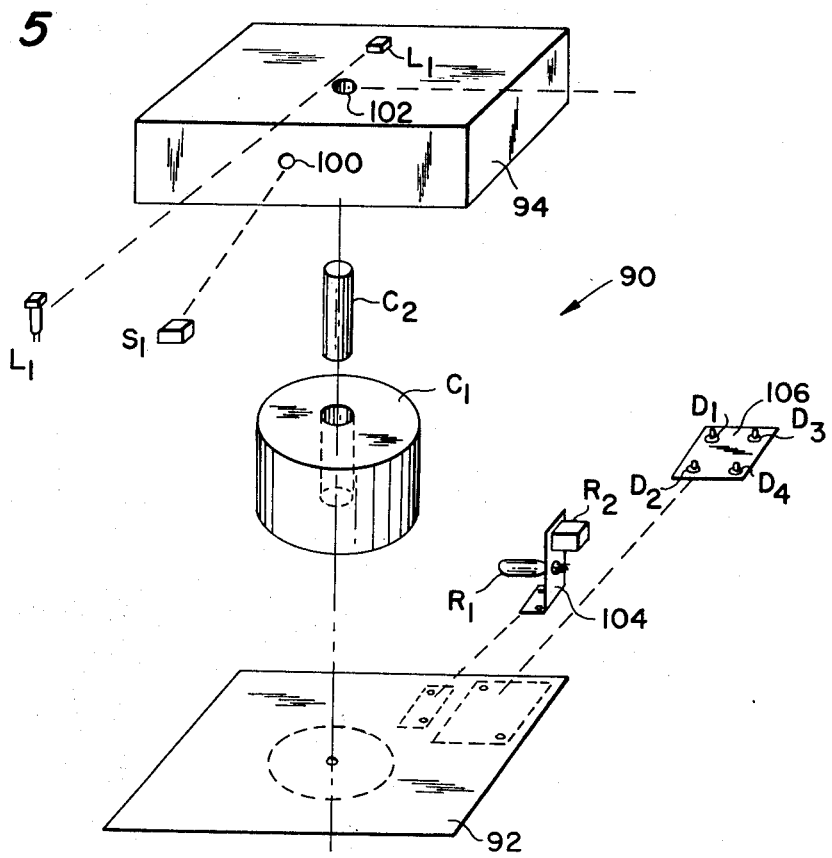
FIG. 5 is an exploded view of the detaching tool in accordance with the invention.

Referring now to FIG. 5, which comprises an exploded view of the detaching tool constructed in accordance with the invention, the detaching tool generally indicated at 90 and includes a bottom plate 92 and a cover 94. Mounted in the cover 94 is an indicator light $L_1$ and a pushbutton switch $S_1$, with the latter being partially exposed at the exterior of the cover through opening 100 formed in a side wall of the cover. As illustrated, the indicator light $L_1$ is exposed through an opening formed in the top of the cover.

Mounted on bottom plate 92 is a magnetic coil $C_1$ formed of copper windings (not shown) and a generally doughnut shaped in cross section. An iron core $C_2$ is mounted for longitudinal movement within the center opening of the coil $C_1$, with the core $C_2$ being somewhat greater in diameter than an opening 102 formed generally centrally in the top wall of the cover 94. The opening 102 is for the purpose of conveniently aligning the iron core with the lock when it is desired to remove the pin from the lock at the checkout station. It will be noted that the coil $C_1$ is relatively large thereby providing a powerful magnetic force on the core $C_2$ for retracting the insert 26 upwardly in the housing 24 of the lock when the lock is positioned adjacent the detaching tool. As previously described, the retraction of the insert 26 permits transverse outward movement of the retaining balls 44 and 46 thereby permitting removal of the pin 52 from the lock at the checkout station.

Also mounted on the bottom plate 92 are relays $R_1$ and $R_2$ which are carried on bracket 104 which is secured to the bottom plate by any suitable means. A rectifier plate 106 carrying rectifiers $D_1$, $D_2$, $D_3$, and $D_4$ is also mounted on the bottom plate 92 adjacent the relays $R_1$ and $R_2$.

Figure 6:
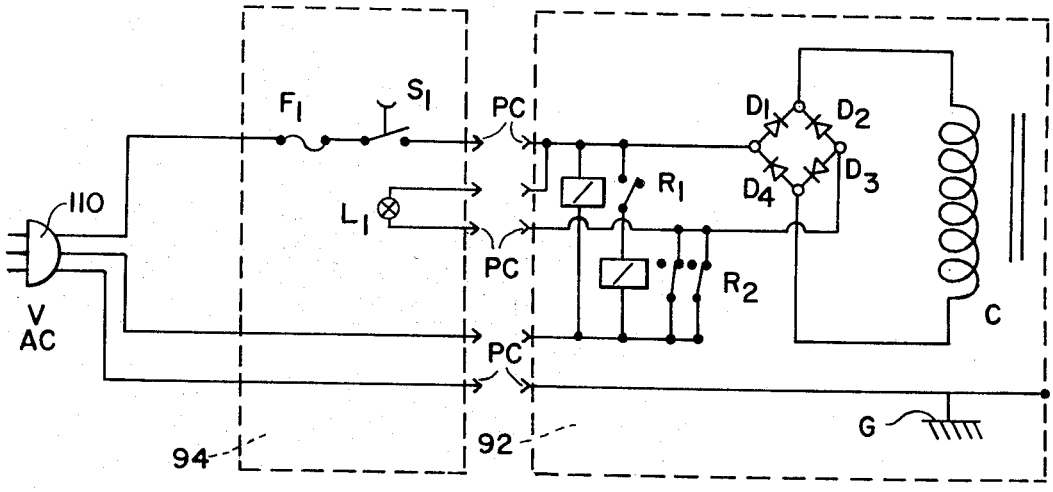
FIG. 6 is a circuit diagram of the detaching tool.

Referring to FIG. 6, the circuit diagram for the detaching tool, the cover 94 and bottom plate 92 are shown in dash lines in the circuit diagram, and it will be noted that plug connectors commonly designated at PC are provided on the cover and bottom plate for plugging in the cover to the plate. Such method of assembly permits the cover to be removed quickly and easily from the bottom plate for repair or replacement of the circuit parts. A power plug 110 is provided, shown schematically at the left of the circuit diagram, connected to a suitable source of alternating current such as a wall outlet or the like.

The components previously described in connection with FIG. 5 are illustrated in the schematic diagram, and the operation of the detaching tool should be apparent from the diagram. When the cover is plugged in the bottom plate, the closing of switch $S_1$ activates coil $C_1$ through the diodes $D_1$, $D_2$, $D_3$ and $D_4$ thereby energizing the iron core $C_2$. When the housing of the lock is disposed adjacent the opening 102 in the cover 94 of the detaching tool, the insert is retracted as above described thereby conditioning the tool for removal of the pin. The indicator light $L_1$ forms part of the circuit and is actuated when the switch $S_1$ is closed. A fuse $F_1$ is also included in the switch circuit. The circuit is also grounded as indicated at G.

An important part of the detaching tool comprises an overload protection feature provided by relays $R_1$ and $R_2$. When pushbutton switch $S_1$ is kept in an "on" position for longer than a predetermined time period, for example 60 seconds, relay $R_1$, which is a delay relay, will be activated, with relay $R_1$ in turn activating relay $R_2$. Relay $R_2$, which is normally closed, is opened when activated thereby shutting off power to the coil and preventing overheating of the coil. The overload protection thus insures long life of the coil and thus the detaching tool.

FIGS. 7 and 8 illustrate modifications in which the pin is permanently attached to the tag. Referring to FIG. 7, which is particularly suited for applying the tag to hardware items, tools, sporting goods and the like, the pin 52 is secured to one end of a chain 120, by soldering, for example. The other end of the chain 120 is attached to a rivet 122 secured to the tag cover section 14. In use, the chain 120 is looped around the article to which the tag is to be attached, with the pin extending into opening 120 as previously described to lock the pin, and thus the article, to the tag. The modification has the further advantage of the pin being permanently attached to the tag to facilitate application of the pin to the lock.

Referring to FIG. 8, in this form the pin 52 is permanently attached to a strip 124, preferably of plastic, one end 126 of which is secured to the tag cover section 14 by riveting or ultrasonic welding so as to rigidly secure the connection. The main body portion of the tag is of less thickness than the end portion 126, and the plastic material and method of attachment to the tag is such that the strip is normally biased away from the tag as shown in FIG. 8. This modification is particularly useful for application of the tag and lock to soft goods such as clothing, with the pin 52 being mounted on the strip 124 so as to be aligned with the lock when the pin is moved toward the lock. This modification also has the advantage, as in FIG. 7 of the pin being permanently connected to the tag to facilitate handling and application of the tag assembly to the goods.

It will thus be seen that the objects of the invention have been accomplished. The tag assembly which mounts the lock and houses the antenna circuit is constructed of a rugged plastic material which insures long life of the tag without significant deterioration. The antenna is sealed within the tag, and the lock is mounted at one end of the tag assembly in such a manner as to preclude removal from the tag. The tag and lock are therefore virtually fool-proof and permit alarm detection at an exit or exits from the store when the tag and lock are attempted to be removed with an article without authorization. The pin can be detached from the lock simply and quickly by the detaching tool thereby permitting subsequent reassembly of the pin with the lock on other articles to be protected. The detaching tool is simple in construction and provides a strong magnetic force for actuating the lock at the checkout station, with the tool being simply positioned adjacent the lock and the actuating switch depressed to close the circuit through the magnetic coil. The detaching tool includes an overload protection feature which precludes actuation of the magnetic coil beyond a predetermined time period thereby preventing overheating of the coil and premature failure of the detaching tool.

I claim:

1. A composite tag assembly comprising:

a. a tag including top and bottom tag cover sections rigidly secured together, one of said sections being formed with a tubular extension;

b. antenna means and diode means mounted between said tag cover sections, said antenna means including a first antenna leg and a second antenna leg electrically connected to said first antenna leg through said diode means, said diode means being mounted on said antenna means in such a manner as to increase the frequency received by said first antenna leg at a predetermined rate whereby said second antenna leg transmits said increased frequency for actuating an alarm circuit, and c. a lock mounted in said tubular extension, said lock comprising a generally cylindrical non-metallic housing closed at one end; a ring mounted in said housing, said ring being formed with a downwardly and inwardly tapered inner surface; an insert formed of magnetic material loosely received within said housing, said retainer being formed with a conical lower end adapted to mate with said tapered surface of said ring, an axial bore, and at least one transverse opening formed in said conical end of said insert; a pin extending upwardly through said axial bore of said insert; a plurality of retaining balls disposed within said transverse opening of said insert, and resilient means for biasing said insert toward the open end of said housing thereby adapting said balls to tightly frictionally engage said pin and retain the same in said insert.

2. The tag assembly of claim 1 wherein said tag sections are formed of a rigid plastic material and are provided with longitudinally and transversely extending interior reinforcing ribs, and wherein said antenna means is carried by an adhesively coated tape, said diode means being mounted on a conductive ribbon on said second antenna leg.

3. The tag assembly of claim 1 wherein said tubular extension is recessed at the top thereof and said housing is formed with a peripheral flange at the open end thereof, said flange extending into said recess for preventing withdrawal of said housing when said tag is assembled, the side wall of said housing being inwardly tapered to permit rotation of said housing in said tubular extension.

4. The tag assembly of claim 1 wherein said pin is permanently attached to the tag by means of a chain secured to the top tag cover section.

5. The tag assembly of claim 1 wherein said pin is permanently attached to one end of a strip the opposite end of which is securely attached to the top tag cover section, the strip thereby being hinged to such section for movement of the pin into engagement with said lock.

* * * * *